US005338094A

United States Patent [19]

Perry

[11] Patent Number: 5,338,094

[45] Date of Patent: Aug. 16, 1994

[54] FLEXIBLE RECLINING CHAIR

[76] Inventor: Charles O. Perry, 20 Shorehaven Rd., Norwalk, Conn. 06855

[21] Appl. No.: 121,185

[22] Filed: Sep. 14, 1993

Related U.S. Application Data

[63] Continuation-in-part of Ser. No. 793,357, Jan. 9, 1992, which is a continuation-in-part of Ser. No. 757,734, Sep. 11, 1991, abandoned, which is a continuation-in-part of Ser. No. 506,716, Apr. 10, 1990, abandoned, which is a continuation-in-part of Ser. No. 381,151, May 2, 1989, Pat. No. 5,009,466, which is a continuation-in-part of Ser. No. 185,707, Apr. 25, 1988, abandoned.

[51] Int. Cl.[5] ..... A47C 1/00

[52] U.S. Cl. ..... 297/411.4; 297/286; 297/354.11; 297/445

[58] Field of Search ..... 297/411.40, 411.41, 297/411.44, 445, 354.11, 286

[56] References Cited

U.S. PATENT DOCUMENTS

| | | | |
|---|---|---|---|
| D. 102,099 | 11/1936 | Wexelblatt . | |
| 2,345,926 | 4/1944 | Fields et al. . | |
| 2,532,025 | 11/1950 | Johnson | 297/286 |
| 2,617,471 | 11/1952 | Lorenz . | |
| 2,838,095 | 6/1958 | Deaton | 297/411.41 X |
| 3,712,666 | 1/1973 | Stoll | 297/61 |
| 4,131,315 | 12/1978 | Vogtherr | 297/286 |
| 4,522,444 | 6/1985 | Pollock | 297/239 |
| 4,640,548 | 2/1987 | Desanta | 297/320 |
| 4,641,885 | 2/1987 | Brauning | 297/300 |
| 4,648,653 | 3/1987 | Rowland | 297/239 |
| 4,653,806 | 3/1987 | Willi | 297/300 |
| 4,711,491 | 12/1987 | Ginat | 297/301 |
| 4,732,424 | 3/1988 | Uredat-Neuhoff | 297/317 |
| 4,744,600 | 5/1988 | Inoue | 297/326 |
| 5,009,466 | 4/1991 | Perry | 297/323 |

FOREIGN PATENT DOCUMENTS 610741 10/1948 United Kingdom .

*Primary Examiner*—Peter R. Brown
*Attorney, Agent, or Firm*—Limbach & Limbach

[57] ABSTRACT

An improved reclining chair has a continuous loop seat frame supported at each arm by a support fork. The seat frame loop extends symmetrically from an upper bearing portion around the seat back, then forward forming arm portions, then downward, then rearward along lateral side portions, then upward and around the seat back to a lower bearing surface. The seat back is pivotally attached to the upper bearing portion and the lower bearing portion.

3 Claims, 7 Drawing Sheets

FLEXIBLE RECLINING CHAIR

RELATED APPLICATIONS

This application is a continuation-in-part of my prior application Ser. No. 793,357 filed Jan. 9, 1992, which was in turn a continuation-in-part of Ser. No. 757,734 filed Sep. 11, 1991, now abandoned, which was in turn a continuation-in-part of Ser. No. 506,716 filed Apr. 10, 1990, now abandoned, which was in turn a continuation-in-part of Ser. No. 381,151 filed May 2, 1989, now U.S. Pat. No. 5,009,466 dated Apr. 23, 1991, which was in turn a continuation-in-part application Ser. No. 185,707 filed Apr. 25, 1988, now abandoned.

BACKGROUND OF THE INVENTION

I have previously disclosed various forms of flexible and reclining chairs in the above-referenced applications and patents, and commercial chairs embodying some of the principles disclosed therein are offered for sale as the Perry Chair by Krueger International Company of Green Bay, Wis.

SUMMARY OF THE INVENTION

I have now developed an improved reclining chair in which a continuous loop seat frame is supported at each arm by a two-tined support fork. The seat frame loop runs from an upper bearing portion, where a seat back is pivotally attached, around each side of the seat back then forwardly and downwardly, forming arm portions to which the support fork is pivotally attached, then rearwardly and upwardly around the seat back to a lower bearing surface, where the seat back is again pivotally attached.

The spring force of the seat frame, the pivotal action of the seat back, and the torsion and bending action of the support fork combine to create a reclining chair that is cost efficient to manufacture yet extremely comfortable.

A better understanding of the features and advantages of the present invention will be obtained by reference to the following detailed description of the invention and accompanying drawings which set forth an illustrative embodiment in which the principles of the invention are utilized.

DETAILED DESCRIPTION OF THE INVENTION

Figure 1:
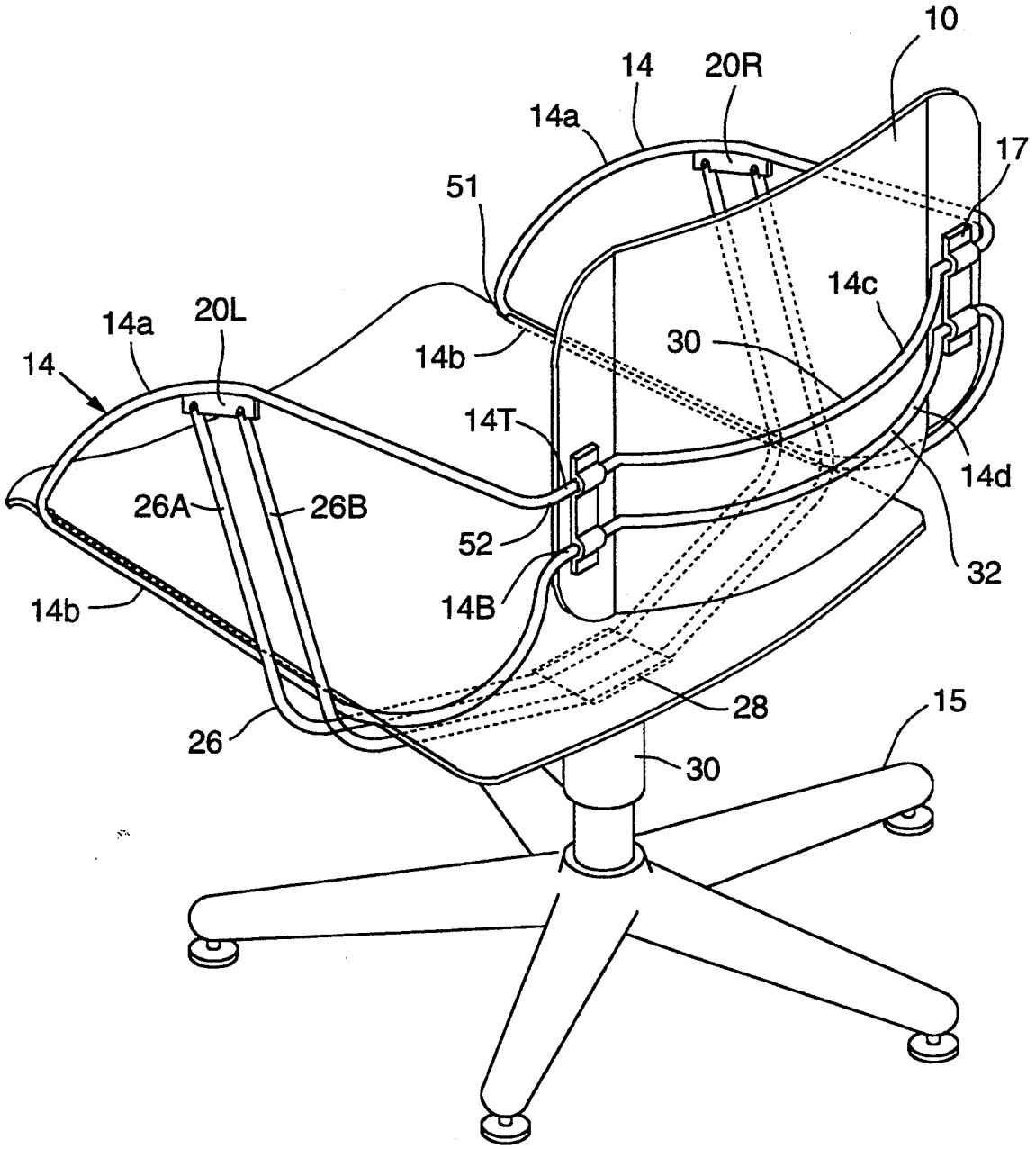
FIG. 1 is a perspective view of a chair according to the present invention.

Referring now to FIG. 1, a seat back 10 and a seat bottom 12 are interconnected by a seat frame 14. The seat frame 14 is supported at each arm by a support fork 26, which is in turn supported on a conventional base and swivel apparatus 15.

Figure 2:
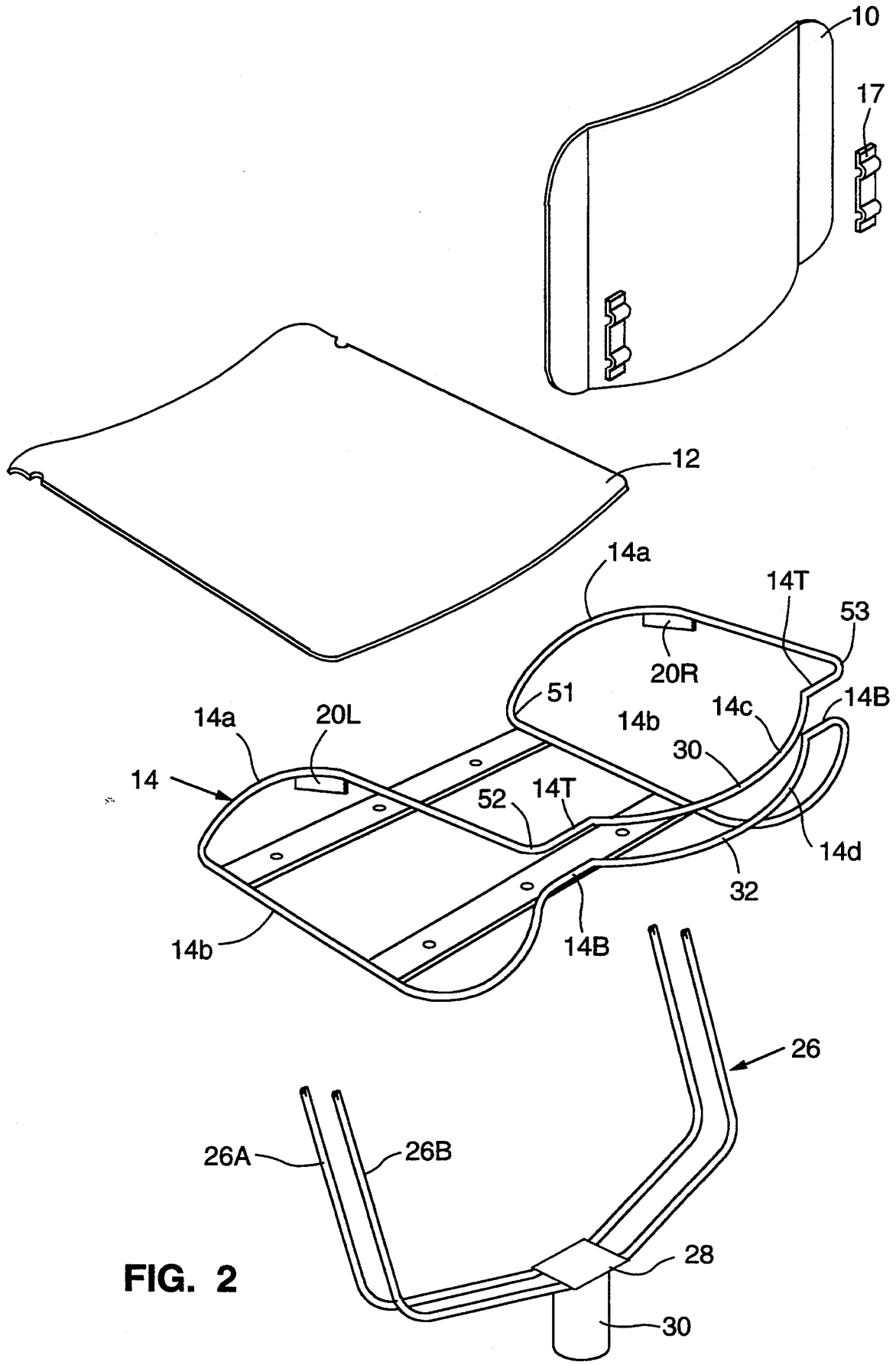
FIG. 2 is an exloded view of the chair of FIG. 1.

The seat frame 14 and support fork 26 are illustrated more clearly in the exploded view of FIG. 2. The seat frame 14 forms a continuous loop having identical and symmetrical arm portions 14*a* which extend forwardly and downwardly, bottom portions 14*b* which extend rearwardly and upwardly, rear portions 14*c* connecting the respective arm portions, and rear portion 14*d* connecting the respective bottom portions.

The seat frame 14 is preferably constructed of substantially continuous 7/16 inch bar stock, but may be made of other equivalent materials which provide the strength and the spring force necessary to accomplish the invention. The approximate dimensions of the seat frame 14 are as follows: the horizontal separation between the arm portions 14*a* is approximately 19 inches in the front, i.e., where the arm portions 14*a* connect with the bottom portions 14*b*, and approximately 21 inches at the rear, i.e., where the arm portions 14*a* connect the rear portion 14*c*. The vertical separation between the rear portions 14*c* and 14*d* is approximately 1⅝ inches up to 3; inches. The overall depth of the chair, i.e., from the rear portions 14*c*, 14*d* to where the arm portions connect to the bottom portions, is approximately 16 inches. The tabs 20L, 20R are located approximately half way along the arm portions. The vertical distance from the bottom portions 14*b* to the tabs 20L, 20R is approximately 8 ½ inches.

Straps 16 and 18 are preferably welded to the seat frame 14 along the bottom portion for attachment of the seat bottom 12. Tabs 20L and 20R are also welded to the arm portion 14*a* of the seat frame 14 for attachment of the fork support 26.

The seat back 10 is pivotally attached to the seat frame 14 by hardware 17 at both an upper bearing surface 14T and a lower bearing surface 14B. In a preferred embodiment of the present invention, the upper bearing surface 14T and the lower bearing surface 14B include curved sections 30, 32 which have radii of curvature less than that of the seat back 10 to thereby provide pivotal limits for the tilting seat back 10 in a manner described in my co-pending application Ser. No. 793,357; filed Jan. 9, 1992, the teaching of which is expressly incorporated herein. In this embodiment, however, the upper and lower bearing surfaces 14T, 14B are placed closer together in parallel than in the parent case, preferably being separated by a distance in the range of 1⅝ inches up to 3 inches. I have found that closer placement of these bearing surfaces increases the spring action of frame 10.

The fork support 26 is preferably constructed from ½ inch bar stock. The fork support comprises two parallel bars 26A and 26B which are rigidly attached together by plate 28. The separation between the bars 26A, 26B is approximately 2 inches. The vertical height of the bars 26A, 26B is approximately 11 inches. The horizontal separation between respective left and right ends of the bars is approximately 20 inches. Further, as more clearly seen in FIGS. 3 and 4, the bars 26A, 26B are inclined forwardly from the vertical axis through plate 28 approximately 15 degrees.

The plate 28 has an opening 30 in the bottom thereof into which a swivel support post and rolling base assembly 15 can be attached, as is well known in the art.

Figure 3:
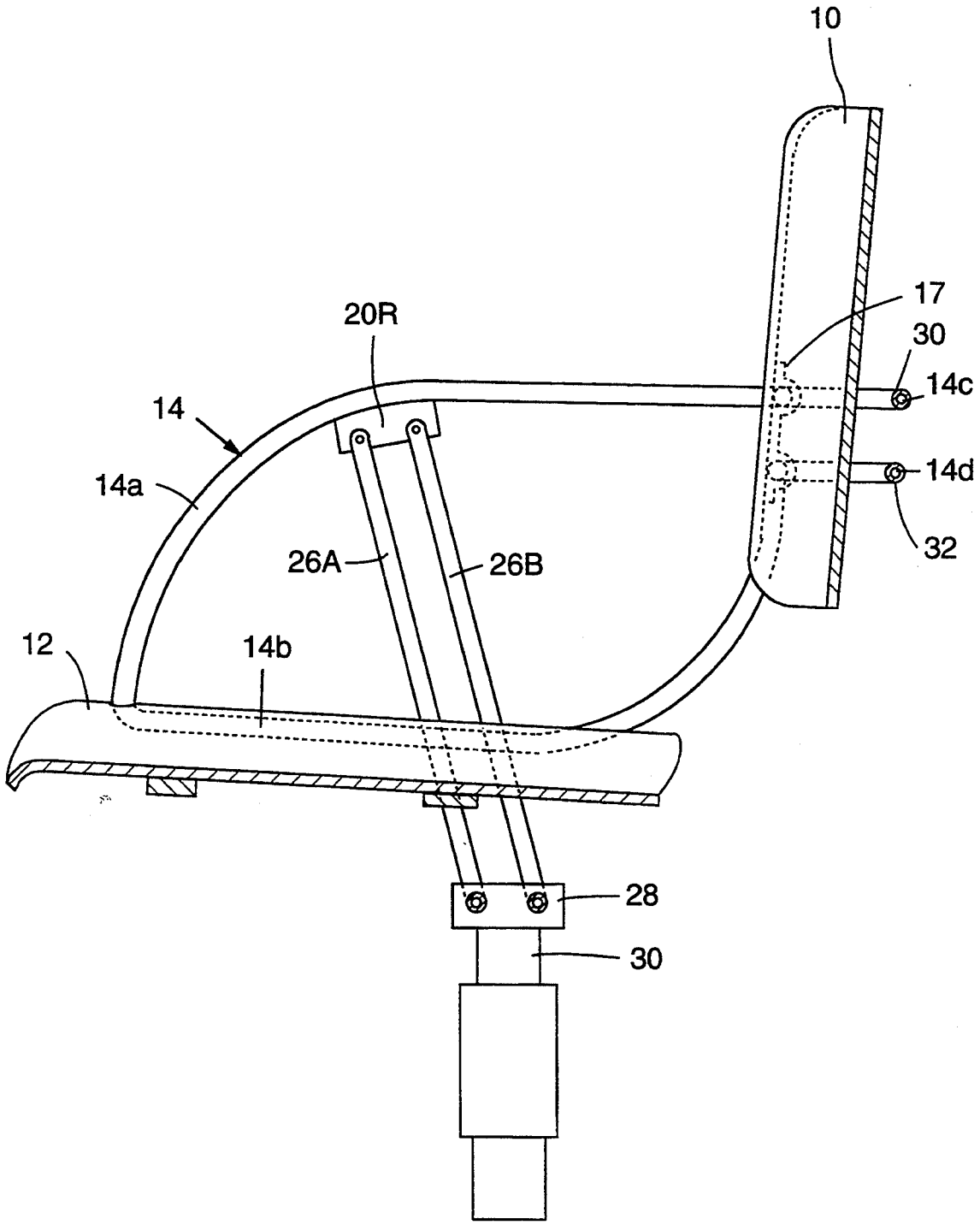
FIG. 3 shows a side plan view of the chair of FIG. 1 in a rest position.
Figure 4:
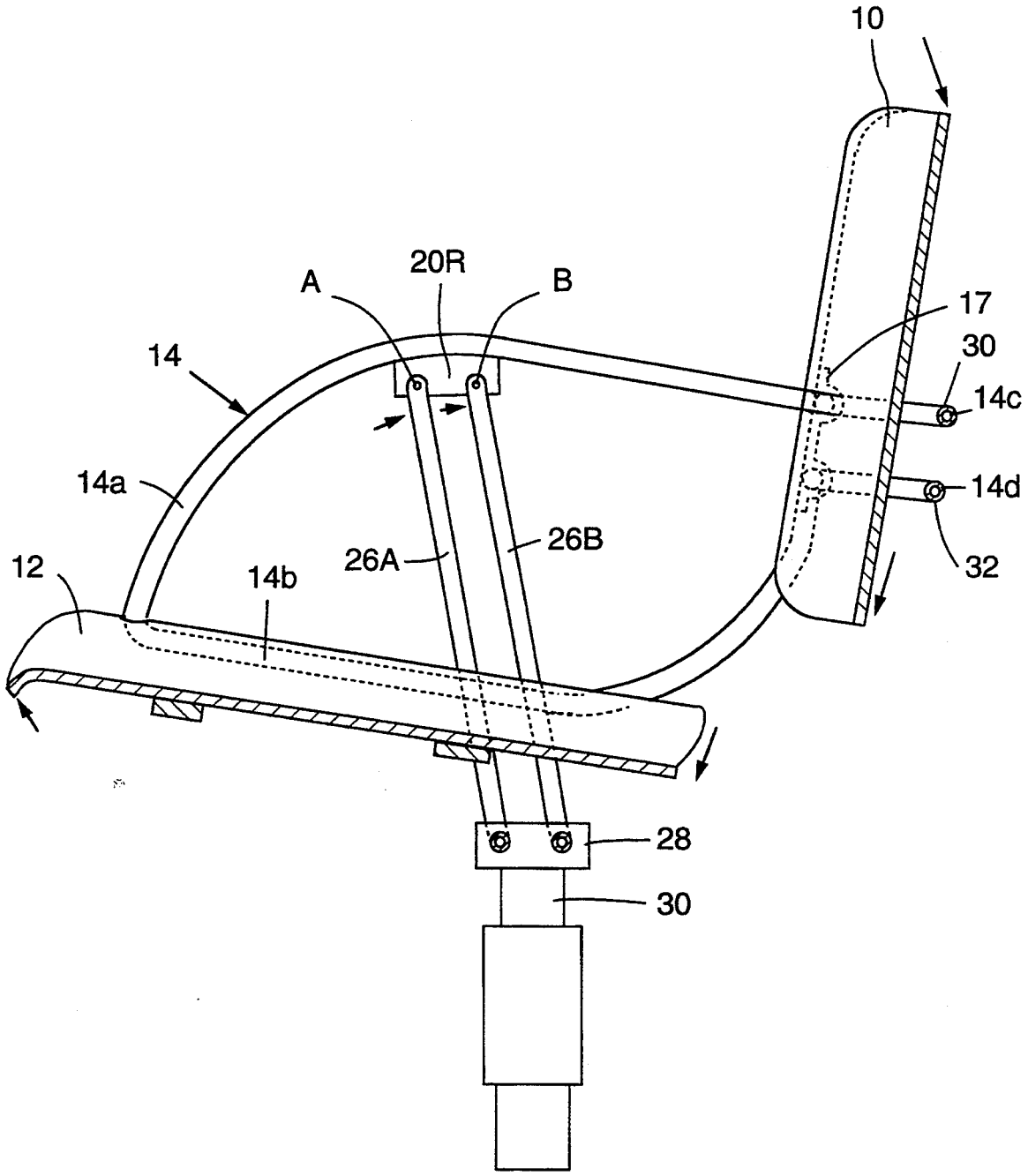
FIG. 4 shows a side plan view of the chair of FIG. 1 in a fully tilted position.

With reference now to FIGS. 3 and 4, it can be seen that the support forks 26A, 26B support the seat frame 14 more or less equally at two pivots points A and B (and corresponding pivot points on the right side of the chair). When the user sits on the chair, his weight pulls down on the seat back 10 and urges the seat back 10 to pivot about bearing surface 14B, which is resisted by the rearward pressure of the user causing the top of the seat back 10 to pivot on the upper bearing surface 14T. The pivoting action of the seat back 10 is further resisted by the spring force of the seat frame 14. Thus, the spring force of the seat frame 14 generally resists rearward pressure on the seat back 10 and keeps the seat back 10 in position. When the user leans backward, greater pressure is placed on the rear pivot B and an upward pull is placed on the front pivot A. At the same time, both of the support forks 26A, 26B are bent forward in torsion while bearing the weight of the user.

Figure 5:
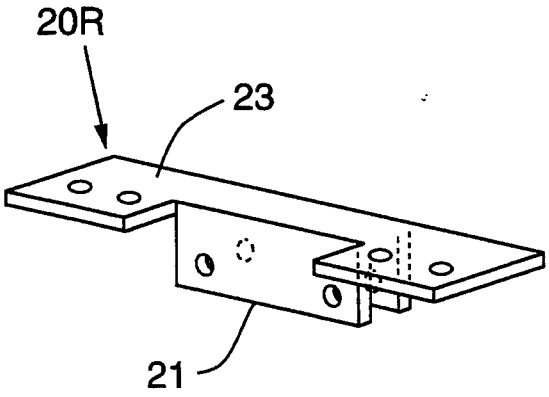
FIG. 5 is a perspective view showing one detail of the frame connection.

Referring now to FIG. 5, the preferred construction of tab 20L is shown, wherein a vertically oriented section 21 is provided with holes to attach the support forks 26A, 26B. A horizontally oriented surface 23 is advantageously provided for the attachment of an arm rest or cushion pad (not shown).

Figure 6:
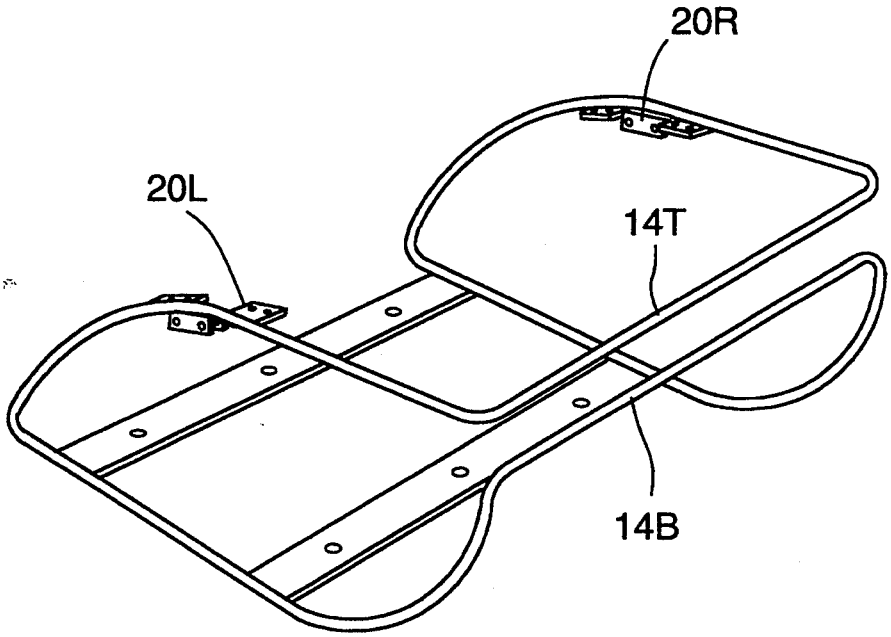
FIG. 6 is a perspective view of an alternative embodiment of the seat frame.

Referring now to FIG. 6, it may be desirable, at least from a manufacturing perspective, to provide relatively straight bearing sections 14T, 14B, as shown.

Figure 7:
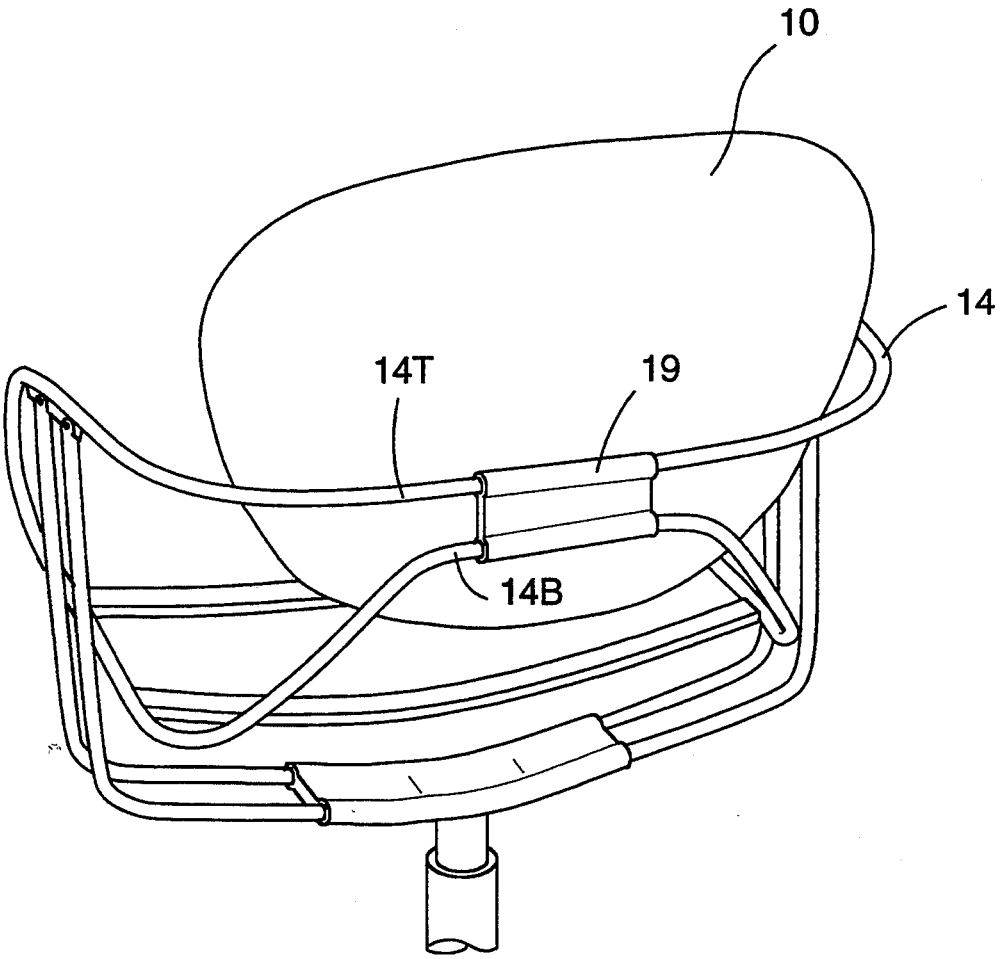
FIG. 7 is a perspective view of another alternative embodiment of the seat frame.
Figure 8:
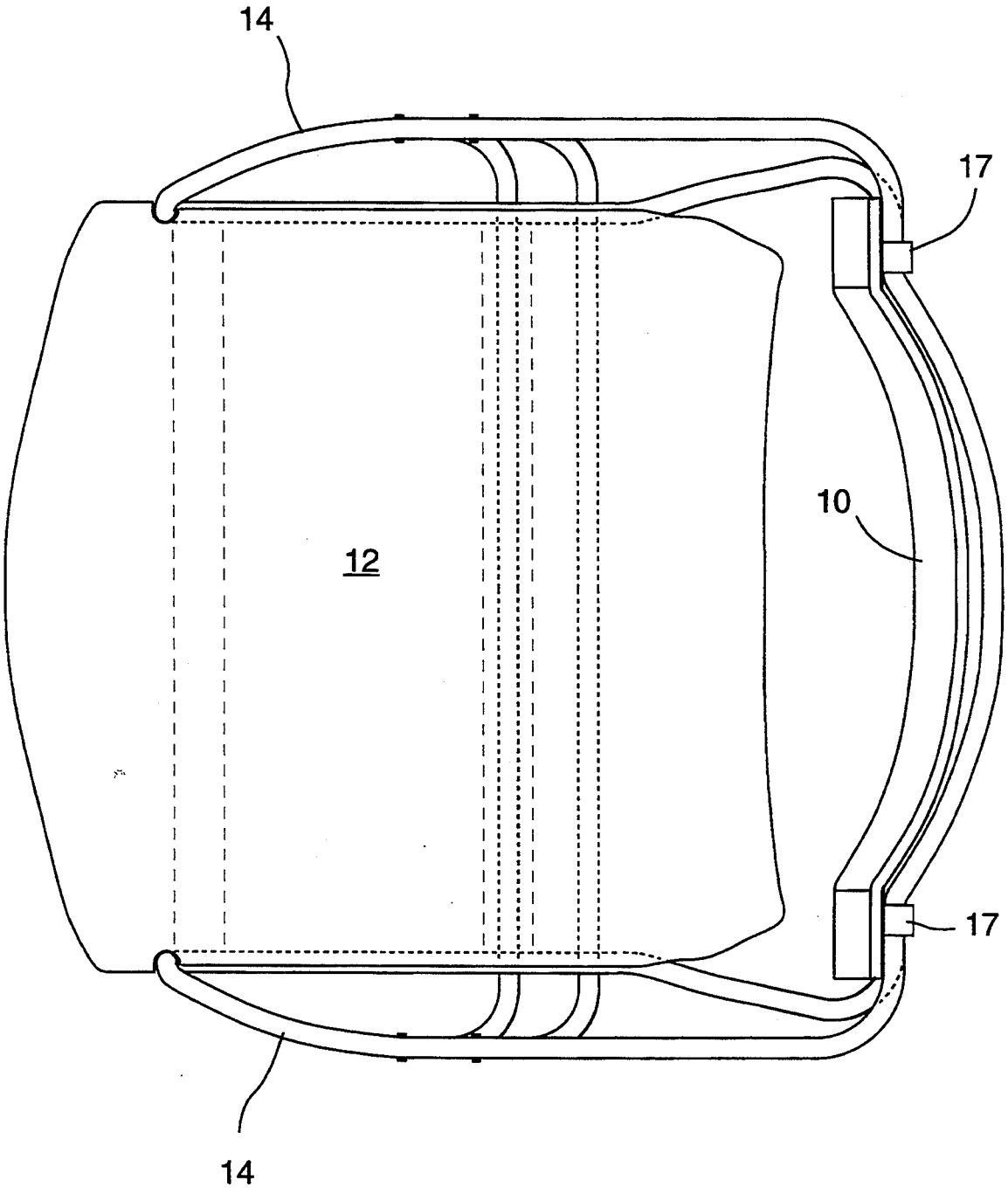
FIG. 8 is a top plan view of the chair of FIG. 1.

Yet another embodiment is illustrated in FIG. 7, where the seat frame 14 is angled more sharply on its rearward run to form the lower bearing section 14B. The upper and lower bearing sections 14T, 14B are pivotally attached to the seat back 10 by hardware 19.

It should be understood that the invention is not intended to be limited by the specifics of the above-described embodiment, but rather defined by the accompanying claims.

I claim:

1. A flexible frame for a chair having a seat back and a seat bottom, comprising;

a seat frame forming a substantially continuous loop symmetrically about the chair beginning from an upper bearing portion then forwardly along arm portions then downwardly then rearwardly along lateral side portions to a lower bearing portion, said seat back being pivotally attached to the seat frame at both the upper bearing portion and the lower bearing portion, said seat bottom being attached to the seat frame between the lateral side portions; and a support frame comprising a pair of parallel support members formed generally into a u-shape and connected to each other at a bottom of the u-shape, each of the support members being pivotally attached at each end thereof to the seat frame at respective arm portions.

2. A flexible chair, comprising:

a seat frame forming a substantially continuous loop symmetrically about the chair beginning from an upper bearing portion then forwardly along arm portions then downwardly then rearwardly along lateral side portions to a lower bearing portion;

a seat back pivotally attached to the seat frame at both the upper bearing portion and the lower bearing portion, a seat bottom attached between the lateral side portions of the seat frame; and a support frame comprising a pair of parallel support members formed generally into a u-shape and connected to each other at a bottom of the u-shape, each of the support members being pivotally attached at each end thereof to the seat frame at respective arm portions.

3. The flexible chair of claim 2, wherein the seat back is curved, and wherein the upper bearing section has a radius of curvature less than that of the seat back, and wherein the lower bearing surface has a radius of curvature less than that of the seat back.

* * * * *